US006755449B2

(12) United States Patent
Weinerman et al.

(10) Patent No.: US 6,755,449 B2
(45) Date of Patent: Jun. 29, 2004

(54) LOCKING SYSTEM AND COMPONENTS THEREOF

(75) Inventors: Lee S. Weinerman, Medina, OH (US); Scott A. Arthurs, Brunswick, OH (US); Arthur J. Kuminski, Parma, OH (US); Leslie A. Farkas, Delhi (CA); Robin T. Green, Tillsonburg (CA)

(73) Assignee: The Eastern Company, Cleveland, OH (US)

( * ) Notice: Subject to any disclaimer, the term of this patent is extended or adjusted under 35 U.S.C. 154(b) by 0 days.

(21) Appl. No.: 10/034,693

(22) Filed: Dec. 27, 2001

(65) Prior Publication Data

US 2002/0056296 A1 May 16, 2002

Related U.S. Application Data

(63) Continuation-in-part of application No. 09/698,416, filed on Oct. 27, 2000, and a continuation-in-part of application No. 29/142,044, filed on May 17, 2001, which is a continuation-in-part of application No. 29/131,819, filed on Oct. 27, 2000, now Pat. No. Des. 447,042, which is a continuation-in-part of application No. 29/113,063, filed on Oct. 28, 1999, now Pat. No. Des. 445,015.

(60) Provisional application No. 60/286,470, filed on Apr. 25, 2001, and provisional application No. 60/162,309, filed on Oct. 28, 1999.

(51) Int. Cl.[7] ..... E05C 3/06

(52) U.S. Cl. ..... 292/198; 292/99; 70/160; 70/162

(58) Field of Search ..... 70/159–162, 169, 70/173; 292/123, 127, 129, 97, 99, 198, 221, 223, 227, DIG. 11, DIG. 37; 248/224.8

(56) References Cited

U.S. PATENT DOCUMENTS

| | | | | |
|---|---|---|---|---|
| 417,589 | A | 12/1889 | Rose | 292/40 |
| 491,824 | A | 2/1893 | Walker | 200/61.64 |
| 767,567 | A | 8/1904 | Keil | 292/127 |
| 876,300 | A | 1/1908 | Couret | 292/135 |
| 925,455 | A | 6/1909 | Campbell | 70/81 |
| 1,058,346 | A | 4/1913 | Berstler | 292/21 |
| 1,531,605 | A | 3/1925 | Gaynor | 200/535 |
| 1,556,864 | A | 10/1925 | Mendenhall | 292/33 |
| 1,571,453 | A | 2/1926 | Maxon | 292/170 |

(List continued on next page.)

OTHER PUBLICATIONS

Japanese Patent 6–336871 Dated Jun. 1994 Classified in E05C 1/16.

Tri/Mark, New Hampton, IA "40–400 Push Button Center Control" 2–Page Brochure Dated 1/98.

*Primary Examiner*—Anthony Knight
*Assistant Examiner*—Christopher J. Boswell
(74) *Attorney, Agent, or Firm*—David A. Burge

(57) ABSTRACT

A locking system for toolboxes, industrial cabinets and the like includes a push button operator assembly connected by at least one movable link to at least one latch mechanism configured to latchingly engage an associated striker to releasably retain a first structure (such as a closure) on which the striker is mounted in a closed position relative to a second structure (such as a cabinet) on which the locking system is mounted. The push button operator assembly has a button that, when unlocked, can be depressed to move the associated link to unlatch the latch mechanism from the striker, and that, when locked, is inoperable when depressed to move the link. Push button operator assemblies are disclosed that can move their associated links in one of two opposite directions (to accommodate the directions of link movement needed to operate the associated latch mechanisms), and these oppositely acting push button operator assemblies may be combined in a locking system where either can operate all of the latch mechanisms of the system.

35 Claims, 11 Drawing Sheets

U.S. PATENT DOCUMENTS

| | | | | | |
|---|---|---|---|---|---|
| 1,672,901 | A | | 6/1928 | North | 292/227 |
| 1,965,939 | A | | 7/1934 | Jacobi | 70/29 |
| 2,059,479 | A | | 11/1936 | North | 292/127 |
| 2,143,965 | A | | 1/1939 | Van Voorhees | 70/153 |
| 2,705,884 | A | | 4/1955 | Craig | 70/264 |
| 2,728,214 | A | | 12/1955 | Craig | 70/149 |
| 2,755,519 | A | | 7/1956 | Xander | 20/52 |
| 2,772,908 | A | | 12/1956 | Craig | 292/280 |
| 2,911,247 | A | | 11/1959 | Corbin | 292/48 |
| 2,977,785 | A | * | 4/1961 | Beckman | 70/141 |
| 2,987,907 | A | | 6/1961 | Cockburn et al. | 70/135 |
| 3,054,634 | A | | 9/1962 | Westerdale | 292/336.3 |
| 3,397,906 | A | * | 8/1968 | Beckman et al. | 292/29 |
| 3,602,017 | A | | 8/1971 | Bauer | 70/78 |
| 3,964,280 | A | | 6/1976 | Kelton | 70/84 |
| 4,059,296 | A | | 11/1977 | Panourgias | 285/312 |
| 4,177,656 | A | * | 12/1979 | Davis | 70/84 |
| 4,488,669 | A | | 12/1984 | Waters | 224/273 |
| 4,637,648 | A | * | 1/1987 | Okino et al. | 296/63 |
| 4,848,810 | A | * | 7/1989 | Gosse et al. | 292/129 |
| 4,978,152 | A | | 12/1990 | Bisbing | 292/169 |
| D313,337 | S | | 1/1991 | Haskell | D8/336 |
| 5,020,835 | A | * | 6/1991 | Poe | 292/127 |
| 5,042,853 | A | | 8/1991 | Gleason et al. | 292/126 |
| D324,635 | S | | 3/1992 | Weinerman et al. | D8/331 |
| 5,308,126 | A | | 5/1994 | Weger, Jr. et al. | 292/53 |
| 5,346,266 | A | | 9/1994 | Bisbing | 292/64 |
| 5,439,260 | A | | 8/1995 | Weinerman et al. | 292/48 |
| 5,526,660 | A | | 6/1996 | Bennett et al. | 70/208 |
| D371,300 | S | | 7/1996 | Mordick | D8/343 |
| 5,564,295 | A | | 10/1996 | Weinerman et al. | 70/208 |
| 5,586,458 | A | | 12/1996 | Weinerman et al. | 70/208 |
| 5,601,206 | A | * | 2/1997 | Haas et al. | 220/527 |
| 5,611,224 | A | | 3/1997 | Weinerman et al. | 70/208 |
| 5,803,516 | A | * | 9/1998 | Hempel | 292/336.3 |
| 5,816,630 | A | | 10/1998 | Bennett et al. | 292/341.17 |
| 5,820,174 | A | * | 10/1998 | Parikh et al. | 292/126 |
| 5,875,948 | A | * | 3/1999 | Sadler | 224/404 |
| 5,884,948 | A | | 3/1999 | Weinerman et al. | 292/216 |
| 5,984,383 | A | | 11/1999 | Parikh et al. | 292/121 |
| 6,012,747 | A | | 1/2000 | Takamura et al. | 292/216 |
| 6,079,585 | A | * | 6/2000 | Lentini | 220/324 |
| D429,141 | S | | 8/2000 | Antonucci et al. | D8/331 |
| 6,113,160 | A | | 9/2000 | Johansson et al. | 292/169 |
| D432,389 | S | | 10/2000 | Johansson et al. | D8/331 |
| 6,151,933 | A | * | 11/2000 | Lentini | 70/159 |
| 6,155,616 | A | * | 12/2000 | Akright | 292/207 |
| 6,231,091 | B1 | | 5/2001 | Gleason et al. | 292/34 |
| D447,042 | S | | 8/2001 | Weinerman et al. | D8/330 |
| 6,349,577 | B1 | * | 2/2002 | Hansen et al. | 70/159 |
| 6,502,868 | B1 | * | 1/2003 | Laspa et al. | 292/26 |

* cited by examiner

LOCKING SYSTEM AND COMPONENTS THEREOF

REFERENCE TO PROVISIONAL APPLICATION

This application claims the benefit of provisional application Serial No. 60/286,470 entitled SLAM CAPABLE LATCH AND LOCK SYSTEM filed Apr. 25, 2001 by Lee S. Weinerman et al, the disclosure of which is incorporated herein by reference.

CROSS-REFERENCE TO RELATED APPLICATIONS

The present application is a continuation-in-part of application Ser. No. 09/698,416 entitled PUSH BUTTON OPERATORS FOR LATCHES AND LOCKS, AND LOCKING SYSTEMS EMPLOYING LOCKABLE PUSH BUTTON OPERATORS filed Oct. 27, 2000 by Lee S. Weinerman et al referred to hereinafter as the "Push Button Operator Assembly Case," which claims the benefit of provisional application Serial No. 60/162,309 entitled LATCH AND LOCK SYSTEM FOR TRUCK TOOL BOXES HAVING LOCKABLE PUSH BUTTON OPERATORS filed Oct. 28, 1999 by Lee S. Weinerman et al, the disclosures of which are incorporated herein by reference.

The present application also is a continuation-in-part of application Ser. No. 29/142,044 entitled PORTIONS OF A CLAMP BRACKET ASSEMBLY FOR USE WITH PUSH BUTTON LATCH AND LOCK OPERATING ASSEMBLIES filed May 17, 2001 by Lee S. Weinerman et al as a continuation-in-part of application Ser. No. 29/131,819 entitled CLAMP BRACKET ASSEMBLY WITH J-SHAPED ARMS FOR USE WITH PUSH BUTTON LATCH AND LOCK OPERATING ASSEMBLIES filed Oct. 27, 2000 now Des 447,042 by Lee S. Weinerman et al as a continuation-in-part of application Ser. No. 29/113,063 entitled FRONT EXTERIOR PORTION OF A LATCH OR LOCK HOUSING WITH PUSH BUTTON OPERATOR filed Oct. 28, 1999 now Des 445,015 by Lee S. Weinerman et al, the disclosures of all of which are incorporated herein by reference.

REFERENCE TO SUBJECT-MATTER RELATED APPLICATIONS

Reference is made to utility application Serial No. 10/034,690 entitled SLAM CAPABLE LATCH AND LOCK SYSTEM filed (concurrently herewith) by Lee S. Weinerman et al, which discloses a locking system for toolboxes and industrial cabinets and the like that can employ push button operating assemblies of the type disclosed in the above-referenced Push Button Lock System Case, and which discloses details of construction and operation of latch mechanisms of a type that may be utilized in the locking system of the present invention, referred to hereinafter as the "Latch Mechanism Case," the disclosure of which is incorporated herein by reference.

Reference also is made to a pair of design applications Serial Nos. 29/152,852 and 29/152,851 both entitled PORTIONS OF A CLAMP BRACKET ASSEMBLY FOR USE WITH PUSH BUTTON LATCH AND LOCK OPERATING ASSEMBLIES filed (concurrently herewith) by Lee S. Weinerman et al, which disclose features of push button operator assemblies that may be utilized in the locking system of the present invention, the disclosures of which are incorporated herein by reference.

BACKGROUND OF THE INVENTION

1. Field of the Invention

The present invention relates to a locking system for toolboxes, industrial cabinets and the like that includes at least one push button operator assembly connected by at least one movable link to at least one latch mechanism configured to latchingly engage an associated striker to releasably retain a first structure (such as a closure) on which the striker is mounted in a closed position relative to a second structure (such as a cabinet or a side or end wall of a tool box) on which the locking system is mounted. The push button operator assembly has a button that, when unlocked, can be depressed to move an associated link to unlatch the associated latch mechanisms from latching engagement with their associated strikers, and that, when locked, is inoperable, when depressed, to move the associated link to unlatch the associated latch mechanisms. Push button operator assemblies are disclosed that can move their associated links in one of two opposite directions (to accommodate the directions of link movement needed to unlatch the associated latch mechanisms), and these oppositely acting push button operator assemblies may be combined in a locking system where either can operate all of the latch mechanisms of the system. In preferred practice, the latch mechanisms are of the "slam capable" type disclosed in the referenced Latch Mechanism Case, meaning that, even when the associated push button operator assemblies are "locked," the strikers can be slammed into latched engagement with their associated latch mechanisms.

In one typical use, one or more of the slam capable latch mechanisms are mounted on the side or end walls of a tool box for releasably retaining a corresponding number of lid-mounted strikers (each associated with a different one of the latch mechanisms) that may be slammed into engagement with the latch mechanisms by closing the lid, wherein one or more of the push button operator assemblies is/are provided for operating the latch mechanisms, with spaced ones of the latch mechanisms and operator assemblies being connected by one or more elongate links that enable each of the push button operator assemblies to unlatch all of the latch mechanisms from their associated strikers, and with key operated locks preferably being incorporated into the push button operator assemblies in the manner disclosed in the referenced Push Button Operator Assembly Case to enable the push button operator assemblies to be "locked" to selectively prevent their push buttons from unlatching the latch assemblies.

2. Prior Art

Latch mechanisms are known that define openings or receiving channels adapted to receive suitably configured strikers that are releasably retained in the openings or channels by hook-shaped arms that pivot to grasp the strikers as they enter the openings or receiving channels. It also is known to attach latch mechanisms of this type to operating devices that include flush mountable, pan shaped housings that nest operating handles that can be moved from non-operated to operated positions to operate (i.e., to "unlatch") the latch mechanisms. Latch mechanisms of this type connected to operating devices of this type are disclosed in U.S. Pat. Nos. 5,984,383 and 5,042,853, the disclosures of which are incorporated herein by reference.

Moreover, it is known to utilize rod-like links to interconnect two or more of the latch mechanisms of the general type described above to provide a plural-point latch system wherein each of the latch mechanisms is associated with and adapted to receive and releasably retain a separate striker, and wherein one or more remotely located operating devices such as push button operator assemblies are provided to concurrently operate (i.e., to simultaneously "unlatch") all of the linkage connected latch mechanisms from their associated strikers. Latch systems of this type are shown in U.S. Pat. Nos. 5,816,630 and 5,308,126, the disclosures of which are incorporated herein by reference, and in the referenced Push Button Operating Assembly Case.

SUMMARY OF THE INVENTION

One feature of the present invention resides in the provision of a push button operator assembly of the type having a housing that surrounds a push button that is movable from a normal position to a depressed position, wherein a clamp-on bracket is provided for pivotally mounting on the housing a link operating lever that is pivotal between one position and another position—wherein the lever is configured to be engaged by the push button so as to pivot from the one position to the another position in response to movement of the push button from the normal position to the depressed position for the purpose of moving a link that is connected to a latch mechanism for operating the latch mechanism. The clamp-on bracket is configured to clampingly engage an exterior surface of the housing of the push button operator assembly and serves to position at least one pivotal lever so that it will be engaged and pivoted by the push button of the push button operator assembly when the push button is depressed.

Although the basic concept of a clamp-on bracket for engaging an exterior surface of the housing of a push button operator assembly is disclosed in the referenced Push Button Operator Assembly Case, this concept is expanded in the present application by introducing additional embodiments of pivoted link operating levers that are supported by clamp-on brackets that can be quickly and easily installed on external surfaces of the housings of push button operator assemblies.

While a clamp-on bracket employing a pair of threaded fasteners to effect clamping is disclosed in the referenced Push Button Operator Assembly Case, a simpler, easier to install clamp-on bracket is disclosed herein that employs a pair of pivotally connected clamping members that require the tightening of only one threaded fastener to clampingly mount the bracket on an external surface of the housing of a push button operator assembly.

In addition to disclosing a selection of new forms of push button operator assemblies, the present application also discloses how these assemblies can be used in combination with known forms of latch mechanisms, and how these push button operator assemblies can be used with a latch mechanism of a particularly advantageous type that is disclosed in the concurrently-filed Latch Mechanism Case.

Latching and locking systems are disclosed that employ at least one of the push button operator assemblies that has a clamp-on bracket that pivotally mounts a link operating lever. In one simple form, a locking system is provided for releasably retaining a closure in a closed position adjacent a structure that defines an opening that is closed by the closure when the closure is in the closed position, wherein the locking system includes 1) at least a first push button operator assembly having a first housing adapted to be connected to a selected one of the closure and the structure, having a first push button that is movable relative to the first housing between a normal position and a depressed position, and having means for biasing the first push button away from the depressed position toward the normal position, 2) at least a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position, 3) wherein the first latch mechanism includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position; and, 4) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF INVENTION EMBODIMENTS

Figure 1:
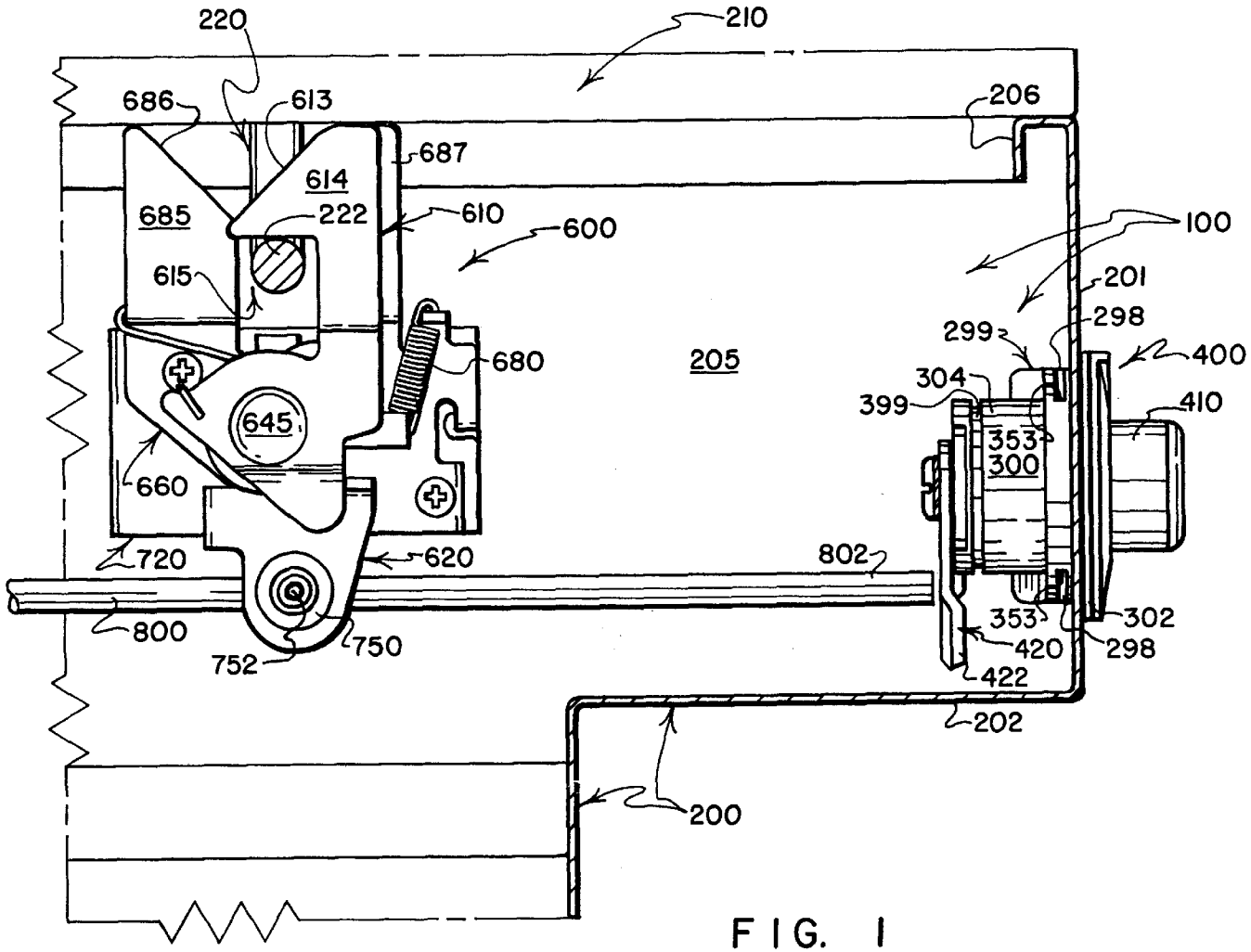
FIG. 1 is a side elevational view showing a right latch mechanism and a right push button operator assembly of a locking system that embodies one form of preferred practice of the present invention mounted in a right end region of a conventional truck-bed-mountable tool box portions of which are broken away and portions of which are shown in cross-section, with the right push button operator assembly shown unlocked, and with the right latch mechanism shown in its normal non-operated position latchingly engaging and releasably retaining a lid-carried striker.
Figure 2:
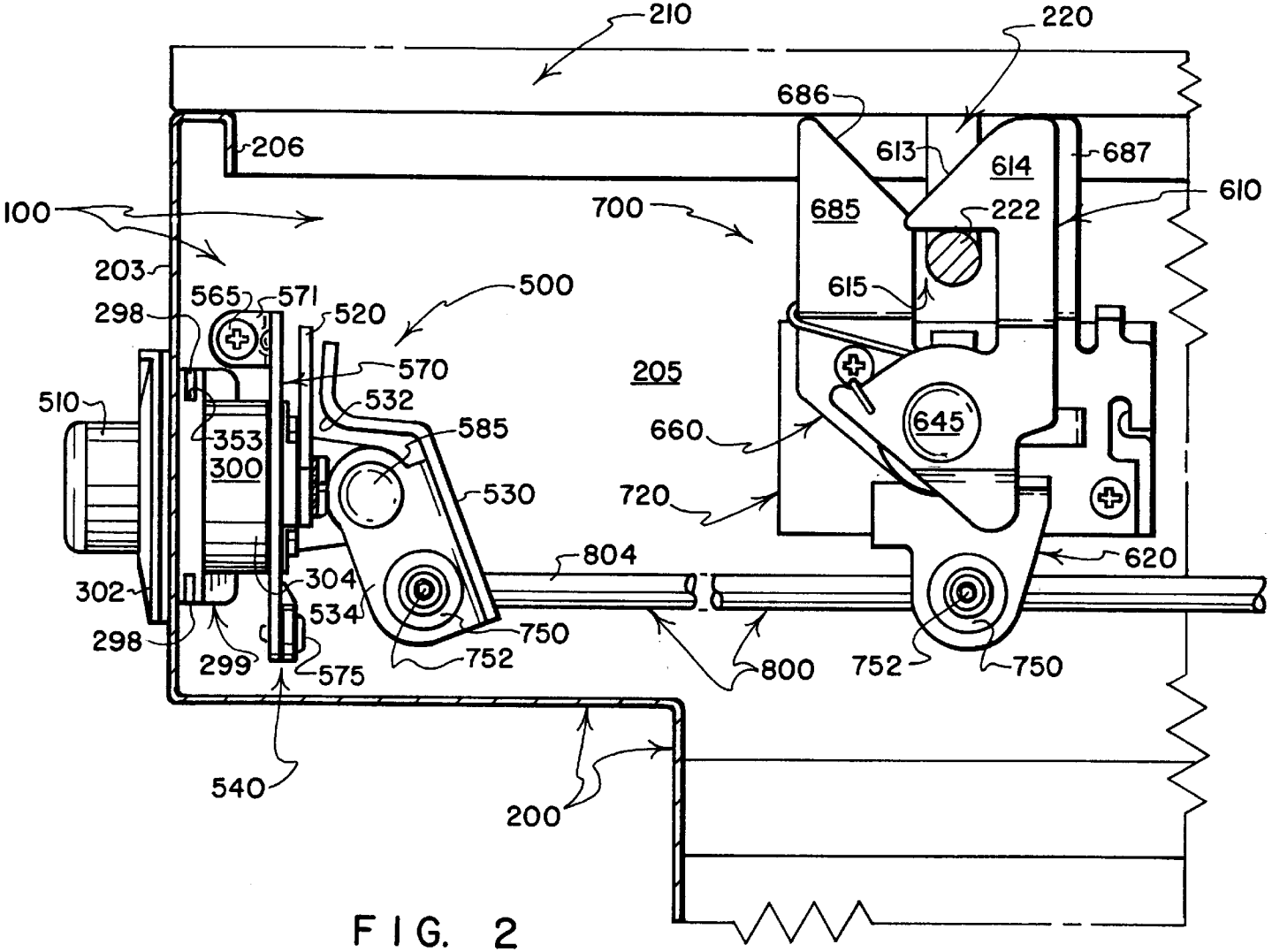
FIG. 2 is a side elevational view showing a left latch mechanism and a left push button operator assembly of the locking system of FIG. 1 mounted in a left end region of a the tool box of FIG. 1, with portions of the tool box broken away and portions shown in cross-section, with the left push button operator assembly shown unlocked, and with the left latch mechanism shown in its normal non-operated position latchingly engaging and releasably retaining a lid-carried striker.

Referring to FIGS. 1 and 2, right and left portions of a locking system that embodies features of the present invention is indicated generally by the numeral 100. The locking system 100 is shown mounted in a conventional tool box 200 having a right end region 202 that is depicted in FIG. 1 and a left end region 204 that is depicted in FIG. 2. The tool box has a top opening 206 that is closed by a lid 210. Right and left strikers 220 depend from the lid 210 and extend through the upwardly facing opening 206 of the tool box 200 and into the interior of the tool box 200 when the lid 210 is closed. The strikers 220 have generally cylindrical bottom formations 222 that are engaged by latch mechanisms 600, 700 of the locking system 100 to releasably retain the lid 210 in its closed position.

Figure 3:
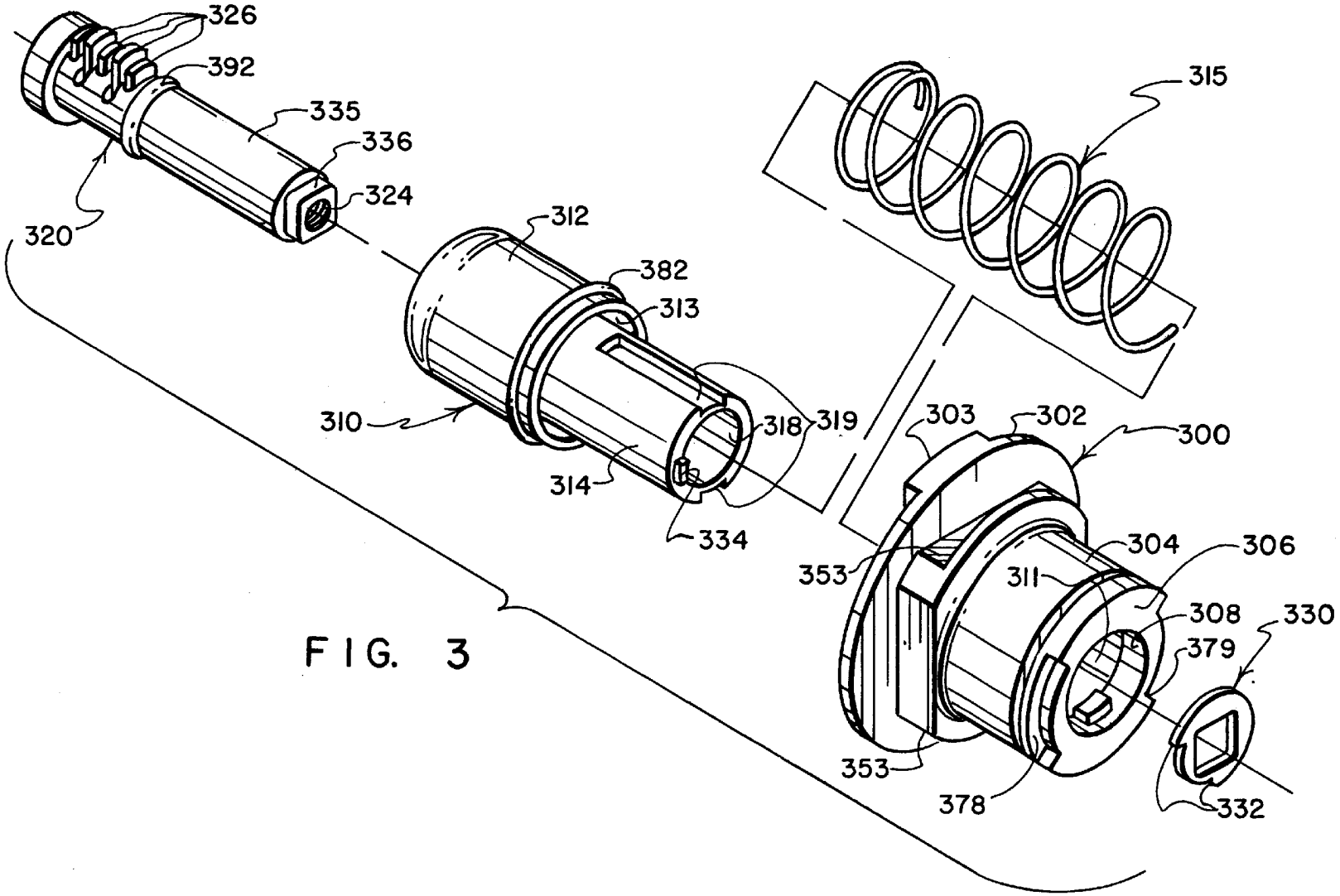
FIG. 3 is an exploded perspective view of components that are found in each of the right and left push button operator assemblies of FIGS. 1 and 2.

In overview, the locking system 100 employs right and left push button operator assemblies 400, 500 that are shown in their normal non-operated orientations in FIGS. 1 and 2, respectively. Components that are common to each of the push button operator assemblies 400, 500 are depicted in FIG. 3. The locking system 100 also employs right and left latch mechanisms 600, 700 that are shown in FIGS. 1 and 2, respectively, in latched engagement with the striker bottom portions 222. The latch mechanisms 600, 700 also are shown in FIGS. 5 and 6 in operated orientations wherein they disengage the strikers 220 so as to permit the lid 210 to be raised to provide access through the opening 206 to the interior of the tool box 200.

The latch mechanisms 600, 700 are connected to the right and left push button operating assemblies 400, 500 by a single elongate link 800. Right and left end regions 802, 804 of the elongate link 800 are shown in FIGS. 1 and 2, respectively.

Figure 4:
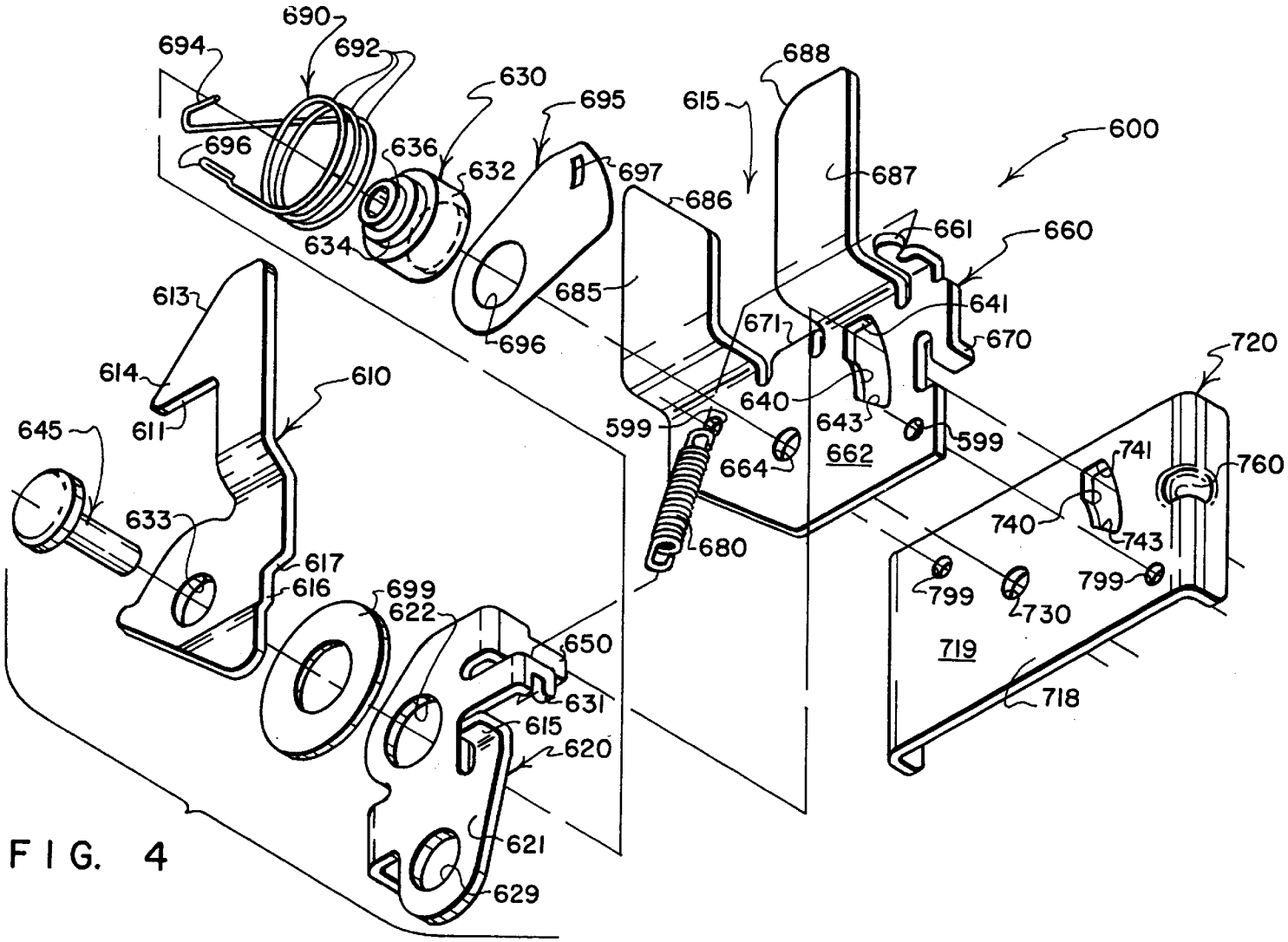
FIG. 4 is an exploded perspective view of components of the right latch mechanism shown in FIG. 1, it being understood that the left latch mechanism is formed from identical components minus the tension coil spring shown in FIG. 4.

Elements of the right latch mechanism 600 are depicted in FIG. 4. The left latch mechanism 700 is identical to the right latch mechanism 600 except that a spring 680 present in the right latch mechanism 600 is absent in the left latch mechanism 700. The left latch mechanism 700 requires no spring 680 because the functions that would be performed by including a spring 680 in the left latch mechanism 700 are, in fact, performed by the spring 680 of the right latch mechanism 600, the action of which is transmitted to the left latch mechanism 700 by the link 800. Moreover, the spring 680 is strong enough to serve the needs of the system 100 in biasing the link 800 toward its normal non-operated position (depicted in FIGS. 1 and 2) away from its operated position (shown in FIGS. 5 and 6).

Figure 5:
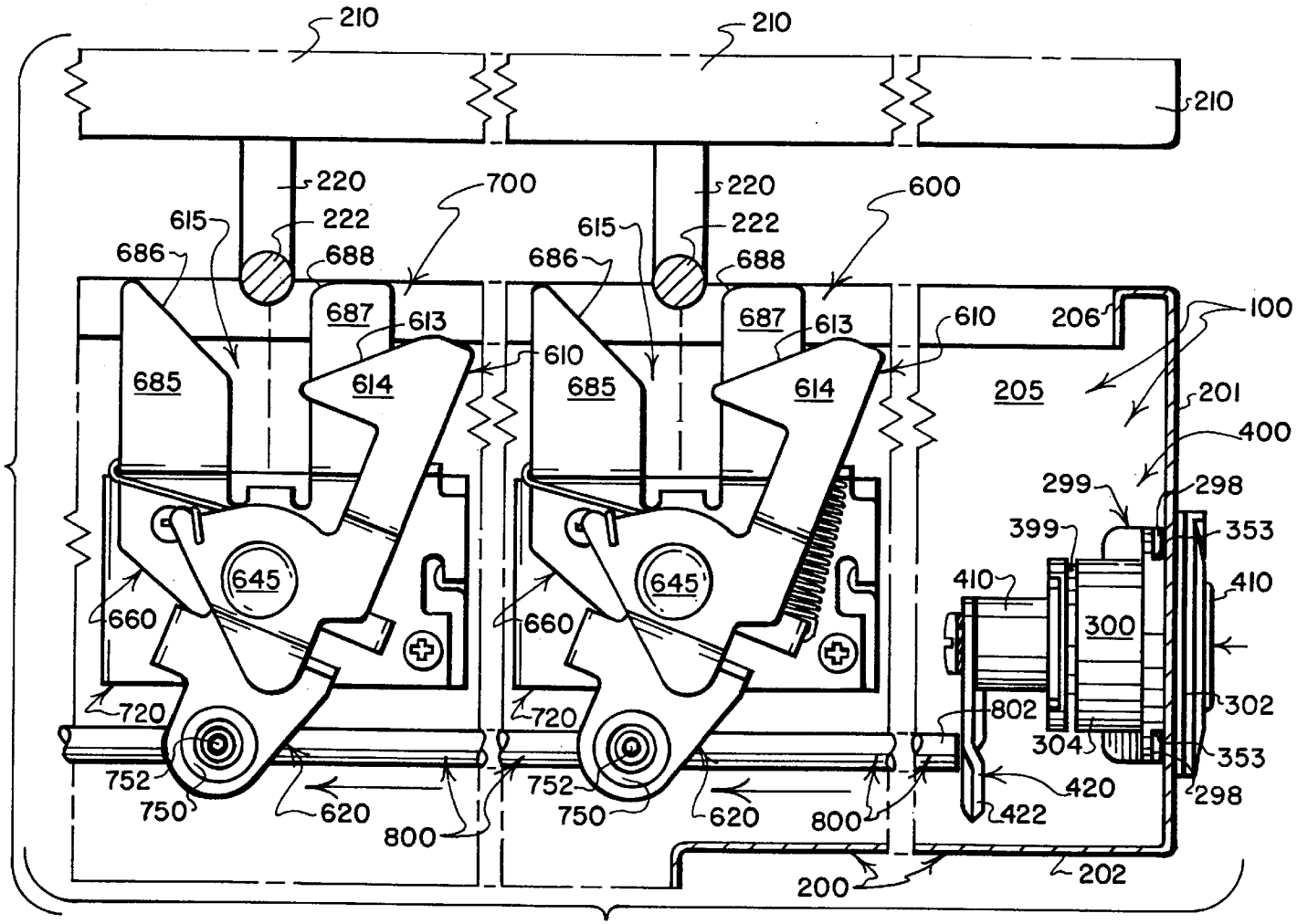
FIG. 5 is a foreshortened side elevational view showing the right push button operator assembly of FIG. 1 operating the right and left latch mechanisms of FIGS. 1 and 2, respectively, and with lid-carried strikers raised out of latched engagement with the right and left latch mechanisms.
Figure 6:
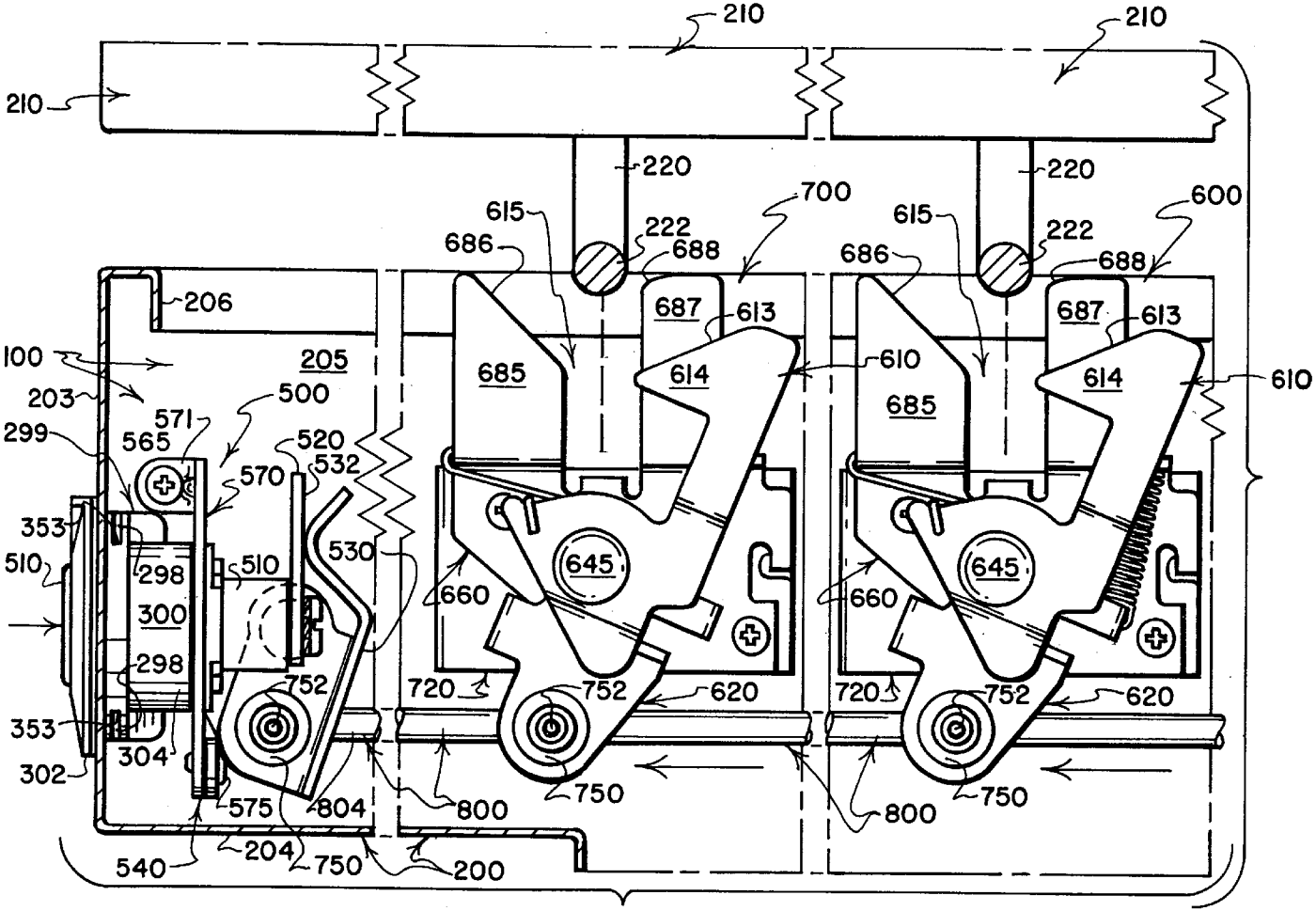
FIG. 6 is a foreshortened side elevational view showing the left push button operator assembly of FIG. 2 operating the right and left latch mechanisms of FIGS. 1 and 2, respectively, and with the lid-carried strikers raised out of engagement with the right and left latch mechanisms.

The manner in which the right push button operating assembly 400 may have its push button 410 depressed to concurrently operate the right and left latch mechanisms 600, 700 is shown in FIG. 5. The manner in which the left push button operating assembly 500 may have its push button 510 depressed to concurrently operate the right and left latch mechanisms 600, 700 is shown in FIG. 6. Operating a selected one of the push buttons 410, 510 causes the link 800 to translate leftwardly as illustrated in FIGS. 5 and 6, but causes no corresponding movement of the other of the push buttons 410, 510.

Figure 7:
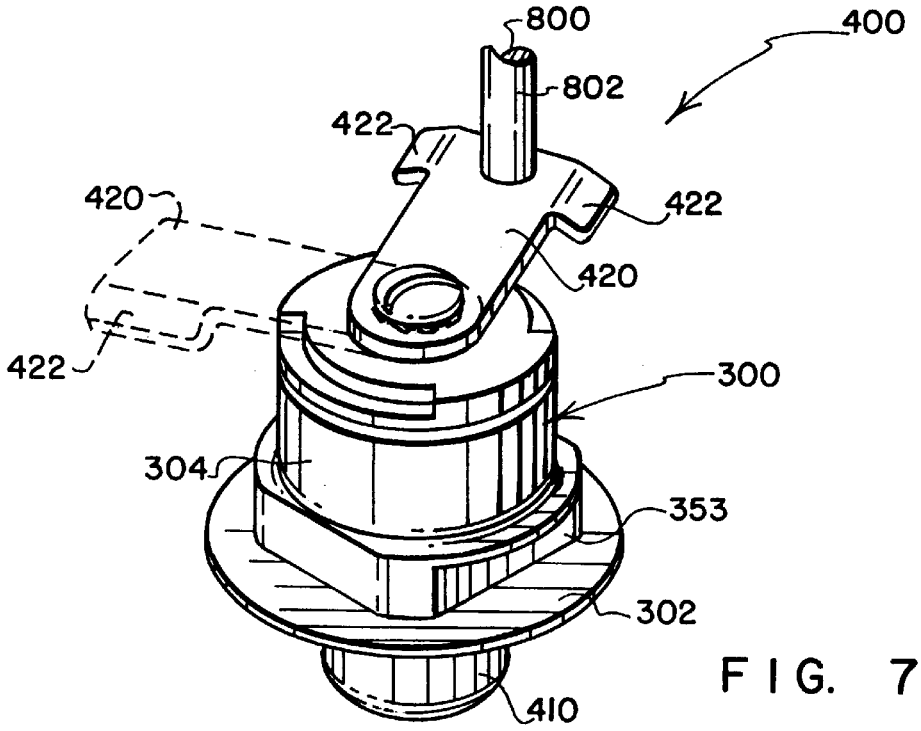
FIG. 7 is a perspective view showing mainly rear portions of the right push button operator assembly of FIG. 1, with a cam thereof shown in solid lines in its unlatched position engaging a link, and in dotted lines in its latched position.

In FIG. 7, the right push button operator assembly 400 is shown in solid lines with its link-engaging cam 420 in an unlocked position that enables the cam 420 to engage and move the right end region 802 of the link 800 to an operated position depicted in FIG. 5. A locked position of the cam 420 is shown in dotted lines in FIG. 7. In its locked position, the cam 420 no longer aligns with and therefore cannot be used to move the link 800.

Figure 8:
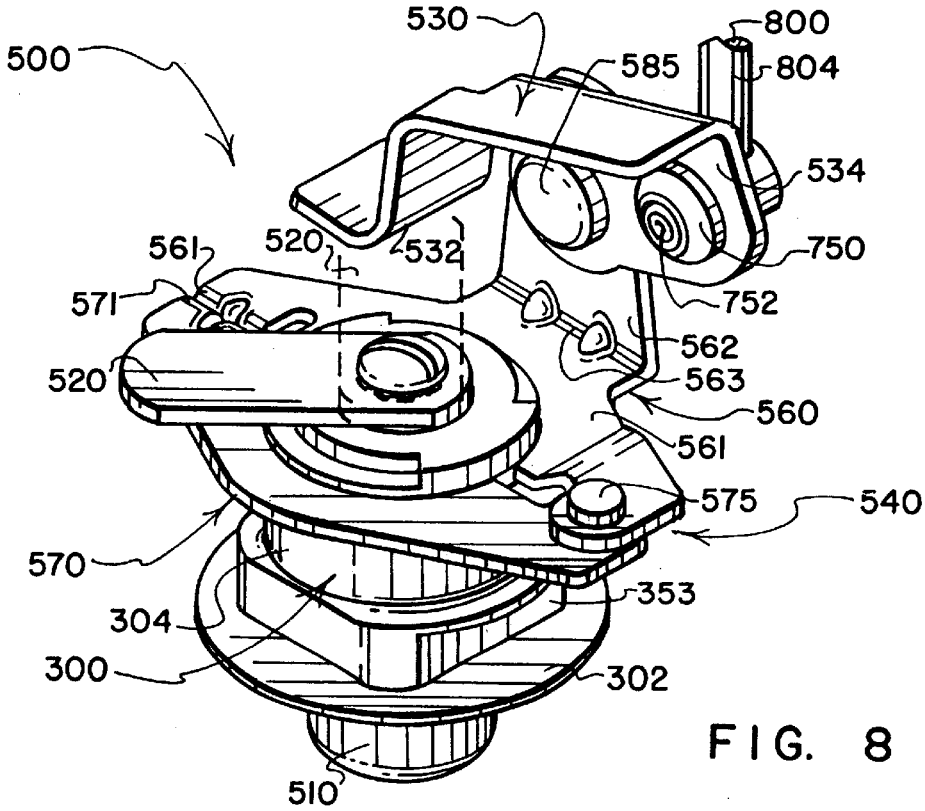
FIG. 8 is a perspective view showing mainly rear portions of the left push button operator assembly of FIG. 2, with a cam thereof shown in solid lines in its latched position, and in dotted lines in its unlatched position, and with an operating lever of the push button operator assembly in its normal non-operated position connected to a link for operating a latch mechanism (not shown)

In FIG. 8, the left push button operator assembly 500 is shown in solid lines with its link-engaging cam 520 in a locked position wherein it does not align with an operating arm 530 of the assembly 500 that is pivotally connected to the left end region 804 of the link 800 by a cylindrical connector 750. An unlocked position of the cam 520 is shown in dotted lines, wherein the cam 520 aligns with and can be used to pivot the operating arm 530 of the assembly 600 from a normal position shown in FIGS. 2 and 8 to an operated position shown in FIG. 6.

Figure 9:
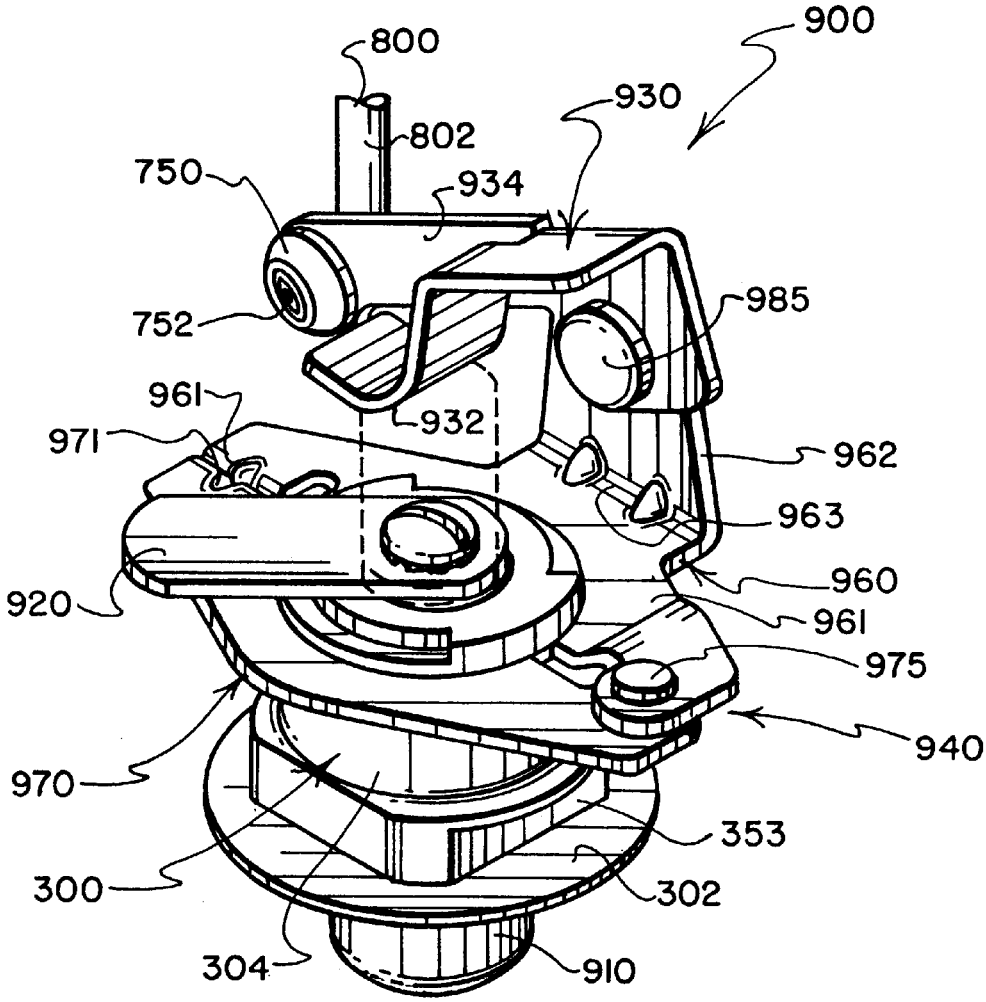
FIG. 9 is a perspective view showing mainly rear portions of an alternate form of push button operator assembly that can be substituted for the right push button operator assembly of FIG. 1, with a cam thereof shown in solid lines in its latched position, and in dotted lines in its unlatched position, and with an operating lever of the push button operator assembly in its normal non-operated position connected to a link for operating a latch mechanism (not shown)

Referring to FIG. 9, an alternate form of push button operator assembly is indicated by the numeral 900. The push button operator assembly 900 can be substituted for the push button operator assembly 400 if it is desired for the right end region 802 of the link 800 to make a more direct type of connection with the right push button operator assembly that is provided by the assembly 400 wherein the cam 420 merely abuttingly engages an end region 802 of the link 800 (see FIGS. 1, 5 and 7). The push button operator assembly 900 differs from the push button operator assembly 700 in that the assembly 900 is designed to "push" the link 800 to operate the latch mechanisms 600, 700, whereas the assembly 700 is designed to "pull" the link 800 to operate the latch mechanisms 600, 700.

Figure 10:
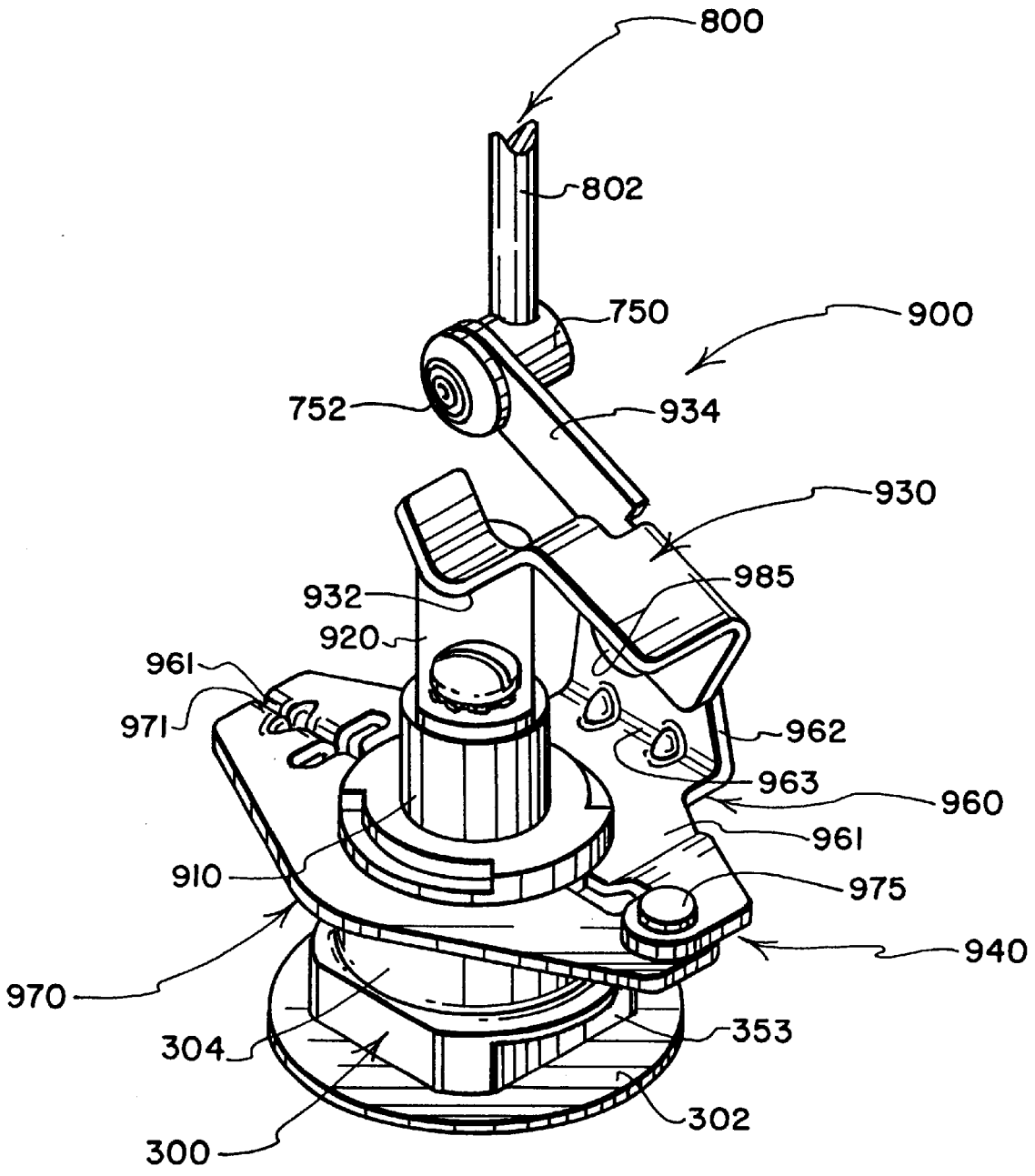
FIG. 10 is a perspective view showing the push button operator assembly of FIG. 9 with the cam thereof in its unlatched position, and with the operating lever thereof in its operated position wherein it has moved the link of FIG. 8 to operate a latch mechanism (not shown)

In FIG. 9, the cam 920 of the push button operator assembly 900 is shown in solid lines in its locked position wherein it is held out of alignment with the operating arm 930 of the assembly 900; and in dotted lines in its unlocked position wherein the cam 920 aligns with the operating arm 930 so as to be able to pivot the operating arm 930 to an operated position in response to depression of the push button 910 of the assembly 900, as is depicted in FIG. 10. The generally cylindrical body of a headed connector 750 extends through a hole formed through the arm 930 to pivotally connect the link end region 802 to the arm 930, which enables the arm 930 to pivot relative to the link 800 in moving to the operated position shown in FIG. 10.

Figure 11:
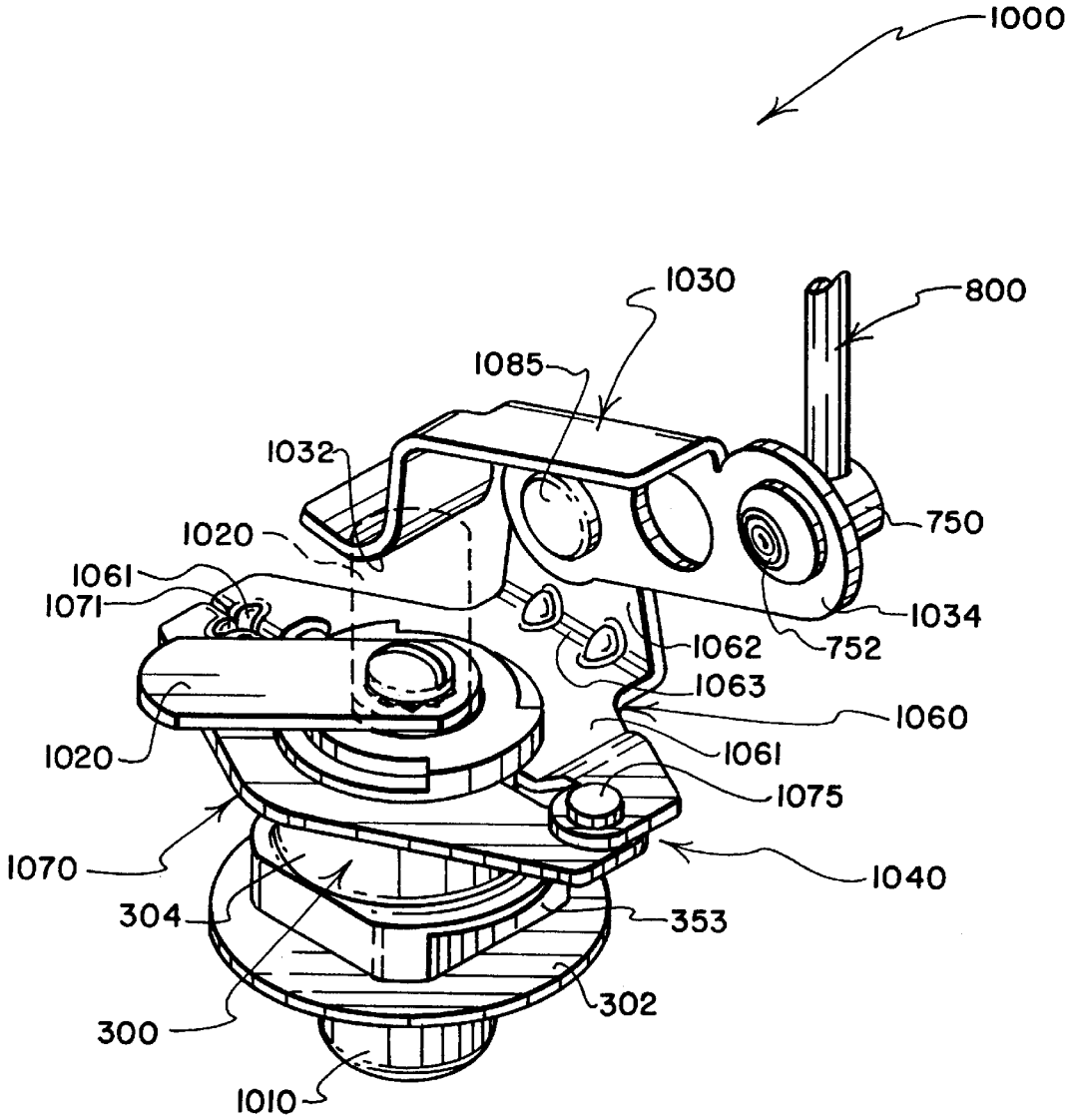
FIG. 11 is a perspective view showing mainly rear portions of still another alternate form of push button operator assembly that can be substituted for the right push button operator assembly of FIG. 1 if a link that is to be moved by the assembly needs to move a longer distance than is provided by the assembly of FIG. 1, with a cam thereof shown in solid lines in its latched position, and in dotted lines in its unlatched position, and with an operating lever of the push button operator assembly in its normal non-operated position connected to a link for operating a latch mechanism (not shown); and, FIG. 12 is a perspective view showing the push button operator assembly of FIG. 11 with the cam thereof in its unlatched position, and with the operating lever thereof in its operated position wherein it has moved the link connected thereto to operate a latch mechanism (not shown).

Referring to FIG. 11, still another alternate form of push button operator assembly is indicated by the numeral 1000. The push button operator assembly 1000 can be substituted for the left push button operator assembly 500 if it is desired for the link 800 to be moved through a greater distance in response to depression of the push button 1010 than is provided by depressing the push button 510 of the push button operator assembly 500. The push button operator assembly 1000 differs from the push button operator assembly 500 in that the link operating arm 1030 is longer than the link operating arm 530 so that, when the arm 1030 is pivoted by the push button 1010, the arm 1030 moves the link 800 through a longer translation than results when the push button 510 pivots the arm 530 of the assembly 500 to translate the link 800.

Figure 12:
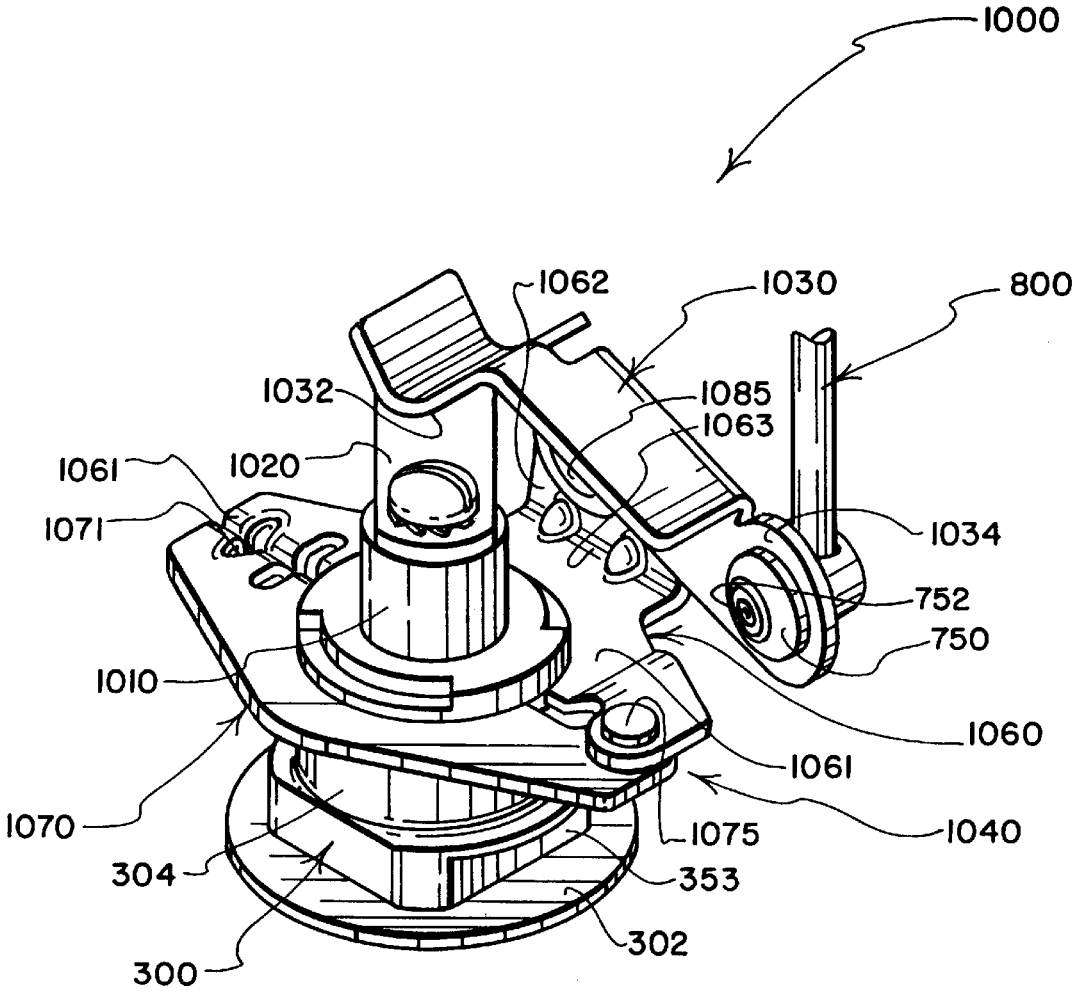

In FIG. 11, the cam 1020 of the push button operator assembly 1000 is shown in solid lines in its locked position wherein it is held out of alignment with the operating arm 1030 of the assembly 1000; and in dotted lines in its unlocked position wherein the cam 1020 aligns with the operating arm 1030 so as to be able to pivot the operating arm 1030 to an operated position in response to depression of the push button 1010 of the assembly 1000, as is depicted in FIG. 12.

While the system 100 does not require that the push button operating assemblies 400, 500, 900 and 1000 be of the general type that is disclosed in the referenced Push Button Operator Assembly Case, in preferred practice the operating assemblies 400, 500, 900 and 1000 are of the general type disclosed in the referenced Push Button Operator Assembly Case. Reference will shortly be made to FIG. 3 wherein components that are common to the push button operator assemblies 400, 500, 900 and 1000 are depicted—a drawing that is much the same as one that appears in the referenced Push Button Operator Assembly Case.

While the system 100 does not require that the latch mechanisms 600, 700 be of the general type that is disclosed in the referenced Latch Mechanism Case, in preferred practice the latch mechanisms 600, 700 are of the general type disclosed in the referenced Latch Mechanism Case. Reference will shortly be made to FIG. 4 wherein components of the right latch mechanism 600 are depicted—a drawing that is much the same as one that appears in the referenced Latch Mechanism Case.

Having provided an overview of the operation of the locking system 100 and its latch mechanisms 600, 700 and its push button operator assemblies 400, 500, 900, 1000, additional details now will be discussed.

Turning to FIGS. 1 and 2, it will be seen that the right push button operator 400 is supported by a right end wall 201 of the tool box 200; that the left push button operator 500 is supported by a left end wall 203 of the tool box 200; and that a back wall 205 connects the right and left end walls 201, 203. A front wall of the tool box that parallels the back wall 205 and also connects the right and left end walls 201, 203 is broken away and not shown in FIGS. 1 and 2—it preferably is what supports the right and left latch mechanisms 600, 700.

Referring to FIG. 3 wherein a typical one of the housings employed by the push button right and left push button operator assemblies 400, 500 is indicated generally by the numeral 300, it will be seen that recesses 353 are provided on opposite sides of the housing 300. Referring to FIGS. 1 and 2, it will be seen that the right and left push button operator assemblies 400, 500 are held in place on the tool box end walls 201, 203 by conventional U-shaped spring clips 299 that have legs 298 that extend into the recesses 353.

Referring to FIG. 3, push button operator assembly components that are common to the push button operator assemblies 400, 500, 900 and 1000 include the generally cylindrical housing 300 which has a front flange 302 and a tubular body 304 that connects with a rear wall 306. A perimetrically extending groove 399 (see FIGS. 1, 3 and 5) is provided near the rear end region of the tubular body 304. The push button operator assemblies 500, 900 and 1000 have brackets 540, 940 and 1040 that extend into the groove 399 and clampingly engage the body 304 at the base of this groove 399 to securely connect the operating arms 530, 930 and 1030 to the body 304.

Referring to FIG. 3, a tubular push button 310 is slidably supported by the housing 300 for forward and rearward movement along a central axis of the housing 300. (In other FIGURES where a specific one of the push button operator assemblies 400, 500, 900 or 1000 is shown, the push button 310 is designated by the numerals 410, 510, 910, 1010.) The push button 310 has an enlarged diameter front end region 312, rear portions of which are received in a slip fit within an inner diameter 311 of the tubular body 304 of the housing 300. Front portions of the front end region 312 normally project forwardly with respect to the front flange 302 of the housing 300. The tubular push button 310 has a reduced diameter rear end region 314 that extends through a hole 308 formed through the rear wall 306 of the housing 300. When the push button 310 is depressed (in the manner in which the push buttons 410, 510 are shown to be depressed in FIGS. 5 and 6, respectively), the rear end region 314 projects rearwardly beyond the rear wall 306.

A compression coil spring 315 is carried within the inner diameter of the tubular body 304 of the housing 300. The spring 315 has a front end region that extends into a counterbore 313 of the push button 310, and a rear end region that engages the rear wall 306 so as to bias the push button 310 forwardly with respect to the housing 300.

Referring still to FIG. 3, a central passage 318 is formed through the push button 310. A generally cylindrical lock core 320 is carried in the passage 318. The core 320 has a key-receiving opening of conventional form (not shown) at its front end. A raised formation 303 is provided on the front flange 302 to indicate a position toward which the key-receiving opening should point when the push button operator assembly 132 is "locked."

The core 320 carries spring biased tumblers 326 near its front end that are of conventional form that cooperate in the usual way with a suitably configured key (not shown) when the key is inserted into the key-receiving opening of the core 320 to withdraw the tumblers 326 into the core 320 sufficiently to permit the core 320 to be rotated within the passage 318. A circumferentially notched washer 330 is provided at the rear of the core 320 that has stop surfaces 332 that cooperate with a stop formation 334 provided at the rear of the push button 310 to limit the rotation of the core 320 (relative to the push button 310) to a ninety degree range of movement. The key is removable from the core 320 when the core 320 is rotated to position the tumblers 326 at either of the ends of this ninety degree range of movement, typically at a 12-o'clock "locked" orientation and at a 3-o'clock "unlocked" orientation.

The core 320 has a threaded hole 324 at its rear end. The rear end region of the core 320 includes a uniform diameter portion 335 that defines at its rear a square formation 336. The square formation 336 drivingly connects with the notched washer 330 and with one of the cams 420, 520, 920, 1020 of the push button operator assemblies (depicted in FIGS. 7–12) by extending snugly through a square hole 336 formed centrally through the notched washer 330 and through a similarly configured square hole formed through one of the cams 420, 520, 920, 1020. A threaded screw 550 (see FIGS. 7–12) is utilized to retain the notched washer 330 and one of the cams 420, 520, 920, 1020 in place on the square formation 336 at the rear end of the core 320. When the screw 550 is threaded into the hole 324 and tightened in place, the core 320 is retained within the central passage 318 of the push button 310 but is permitted to move axially with the push button 310, for example when the push button 310 is depressed.

A pair of opposed, tab-like projections 309 (one of which can be seen in FIG. 3) are provided at opposite sides of the rear wall opening 308 of the housing 300. The tab-like projections 309 are configured to extend into grooves 319 that are provided along opposite sides of the rear end region 314 of the push button 310. The extension of the tab-like projections 309 into the grooves 319 prevents the push button 310 from rotating relative to the housing 300, and yet permits the push button 310 to be depressed rearwardly relative to the housing 300 to move the cams 420, 520, 920, 1020 rearwardly. The push button 310 can be depressed regardless of how the core 320 is oriented, and regardless of whether a key is inserted into the key receiving opening 312, but will only be effective to move the link 800 if the cams 420, 520, 920, 1020 are in their unlatched positions when the push button 310 is depressed.

Referring to FIG. 4, the latch mechanism 600 includes a hook-shaped latch arm 610, an operating arm 620 which defines a projection 650, a stepped-diameter bushing 630 which has a major diameter 632 and reduced diameter portions 634, 636 that extend through holes 622, 632 formed in the arms 620, 630, respectively, and a headed mounting pin 645 that extends through the bushing 630 to mount the latch arm 610 and the operating arm 620 on a frame 660 for pivotal movement about the axis of the pin 645.

The frame 660 has a flat base portion 662 that is provided with a hole 664 through which the mounting pin 645 extends. The frame 660 also has a pair of dog-legged arms 685, 687 that extend rearwardly and upwardly from the flat base portion 662 to define a striker receiving channel 615 between the arms 685, 687. The arm 685 has a tapered surface 686, and the arm 687 has a rounded corner surface 688—and the surfaces 686, 688 can aid in guiding into the channel 615 one of the strikers 220 if the striker 200 is misaligned with the channel 615.

Referring still to FIG. 4, the frame 660 is provided with a curved opening 640 that is shaped the same as and that aligns with a curved opening 540 provided in a mounting bracket 520. Opposite outer and inner ends 541, 543 and 641, 643 of the curved openings 540, 640 serve to limit the range of angular movement of the operating arm 620 about the axis of the pin 645 by limiting the distance that the projection 650 can travel.

The frame 660 may be provided with a forwardly turned tab 670 that is configured to extend into a concavity 760 formed in the rear face of the back wall 518 of the mounting bracket 720. The projection of the tab 670 into the concavity 760 assists in rigidifying the connection that is formed between the frame 660 and the mounting bracket 720—a connection that is maintained by two threaded fasteners (not shown) that extend through aligned holes 599, 799 formed in the frame 660 and the mounting bracket 720.

A front end portion of the pin 645 that extends through the aligned holes 664, 730 of the frame 660 and the mounting bracket 720 may be riveted or suaged or headed to assist in providing a rigid connection between the frame 660 and the mounting bracket 720.

The operating arm 630 and the frame 660 are provided with small hook-shaped formations 631, 661, respectively, to receive opposite ends of a coiled tension spring 680 that biases the operating arm 630 toward a position wherein the operating projection 650 engages outer ends 541, 641 of the curved slots 540, 640.

The operating arm 620 is provided with a link connection hole 629 at a location spaced from the mounting hole 622 that receives the cylindrical body of one of the cylindrical connector members 750 that is used to connect the link 800 to the latch mechanisms 600, 700 and to selected ones of the push button operator assemblies 400, 500, 900, 1000. Each of the connectors 750 carries a set screw 752 (see FIGS. 1, 2, 5, 6 and 8–12) that can be tightened into engagement with the link 800 to rigidly couple the connectors 750 to the link 800.

Referring to FIG. 4, a torsion coil spring 690 has a central coil 692 that wraps loosely about the major diameter 632 of the bushing 630, with hook-shaped end regions 694, 696 that hook into engagement with the frame 660 and the latch arm 610—to bias the latch arm 610 toward a position wherein a hook-shaped end region 614 of the latch arm 610 extends across a striker receiving channel 615 defined between spaced upstanding guide formations 666, 668 of the frame 660. The latch arm 610 can be pivoted to an unlatched position (shown in FIGS. 5 and 6) either by pivoting the operating arm 620 to its operated position (shown in FIGS. 5 and 6), or by slamming the strikers 220 into engagement with a tapered end surfaces 613 of the hook-shaped end regions 614 of the latch arms 610 of the latch mechanisms 600, 700.

When the latch arm 610 is pivoted by slamming a striker 220 into engagement with the tapered end surface 613, the pivoting action of the latch arm 610 in moving from its latched position to its unlatched position causes no corresponding movement of the operating arm 620 due to the provision therebetween of what is commonly referred to in the art as a "lost motion connection." The the latch arm 610 has a pair of surfaces 616, 617, either of which can be moved into engagement with a rearwardly turned projection 625 of the operating arm 620. The latch arm surface 616 normally engages the operating arm projection 625 when the latch arm 610 is in its latched position; but, when the latch arm 610 is pivoted from its latched position to its unlatched position by slamming a striker 220 into engagement with the tapered end surface 613, the surface 616 moves away from the operating arm projection 625, bringing the surface 617 nearly into engagement with the projection 625. By positioning the surface 617 so that it does not need to engage the projection 625 in order to permit the latch arm 110 to latchingly engage the striker 220, the latch arm 610 is permitted to pivot to its unlatched position without causing corresponding pivotal movement of the operating arm 620 (hence the movement of the latch arm 610 can be said to be "lost" to the operating arm 620 in the sense that the pivotal movement of the latch arm 610 is not transmitted to and does not cause corresponding movement of the operating arm 620).

Referring to FIG. 7, the cam 420 of the push button operator assembly 400 has slightly bent-down projections 422 that extend in opposite directions from opposite sides of the cam 420. The projections 422 serve as ramps to guide the end 802 of the link 800 into engagement with the central part of the outer end region of the cam 420 as the cam 420 pivots from its locked position (shown in dotted lines) to its unlocked position (shown in solid lines).

Referring to FIGS. 8–12, the brackets 540, 940, 1040 of the push button operator assemblies 500, 900, 1000 include L-shaped members 560, 960, 1060 and clamping members 570, 970, 1070 that are pivotally connected by pins 575, 975, 1075. The L-shaped members 560, 960, 1060 have transversely extending legs 561, 961, 1061 and rearwardly extending legs 562, 962, 1062 that are joined by right angle bends 563, 963, 1063. The members 560, 570, 960, 970, 1060, 1070 have identically configured, forwardly turned tabs 561, 571, 961, 971, 1061, 1071 (see FIGS. 2 and 6 wherein one of these identical tabs, namely the tab 571, is more clearly shown) that are clamped toward each other by identical threaded fasteners, one of which is depicted in FIG. 2 and indicated by the numeral 565. Threaded fasteners like the fastener 565 depicted in FIG. 2 extend through holes formed in the tabs 561, 571, 961, 971, 1061, 1071 and, when tightened, draw associated ones of the members 560, 570, 960, 970, 1060, 1070 toward each other and into grooves 399 of the housings 300 of the push button operator assemblies 500, 900, 1000 to securely mount the brackets 540, 940, 1040 on the housings 300.

Referring still to FIGS. 8–12, pivot pins 585, 985, 1085 connect the operating arms 530, 930, 1030 to rearwardly extending legs 562, 962, 1062 of the L-shaped members 560, 960, 1060 to mount the arms 530, 930, 1030 for pivotal movement relative to the brackets 540, 940, 1040. The operating arms 530, 930, 1030 have end formations 532, 932, 1032 that are configured to be engaged by the cams 520, 920, 1020, and have other portions 534, 934, 1034 that define holes through which the cylindrical connectors 599 extend which connect with one or the other of the end regions of the link 800.

As will be apparent from the foregoing description taken together with the drawings and the claims that follow, the present invention provides a variety of push button operator assemblies that can be combined in various ways with latch mechanisms of various types to provide latching and locking systems capable of a wide variety of uses—uses that are not restricted to tool boxes, industrial cabinets and the like. The clamp-on bracket and operating arm assemblies can be used with a variety of types of push button assemblies that have housings which slidably support depressible push buttons.

While the system 100 is depicted as employing only a single elongate link 800 to connect its push button operating assemblies and its latch mechanisms, those who are skilled in the art will readily understand that other arrangements of latch mechanisms and operating assemblies connected by plural links and/or by links that rotate instead of translate can employ the inventive features that are embodied in the push button operating assemblies 400, 500, 900 and 1000.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A system for releasably retaining a closure in a closed position adjacent a structure that defines an opening that is closed by the closure when the closure is in the closed position, comprising:

a) a first push button operator assembly having a first housing adapted to be connected to a selected one of the closure and the structure, having a first push button that is movable relative to the first housing between a normal position and a depressed position, and having means for biasing the first push button away from the depressed position toward the normal position;

b) a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position;

c) wherein the first push button operator assembly includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position;

d) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker; and e) wherein the first bracket includes a first member of generally L-shape having first and second legs, with the first leg being configured to engage a first part of the external surface of the first housing located on one side of the first housing, wherein the second leg is pivotally connected to the first arm to mount the first arm for pivotal movement, and wherein the first bracket also includes 1) a second member configured to engage a second part of the external surface of the first housing located on an opposite side of the first housing from the first part of the external surface engaged by the first leg, and 2) means for clamping the first and second members toward each other.

2. The system of claim 1 wherein the linking means includes an elongate link that extends from the first arm to the first latch operating member, and the first arm is operable to push the elongate link to effect movement of the first latch operating member from the non-operated position to the operated position.

3. The system of claim 2 wherein the elongate link is pivotally connected to the first arm.

4. The system of claim 3 wherein the pivotal connection between the elongate link and the first arm is defined by a generally cylindrical member that extends through a hole formed through the first arm and that rigidly connects with an end region of the elongate link.

5. The system of claim 2 wherein the elongate link has an end region that is engaged by the first arm in order for the first arm to effect movement of the first latch operating member from the non-operated position to the operated position.

6. The system of claim 1 wherein the linking means includes an elongate link that extends from the first arm to the first latch operating member, and the first arm is operable to pull the elongate link to effect movement of the first latch operating member from the non-operated position to the operated position.

7. The system of claim 6 wherein the elongate link is pivotally connected to the first arm.

8. The system of claim 7 wherein the pivotal connection between the elongate link and the first arm is defined by a generally cylindrical member that extends through a hole formed through the first arm and that rigidly connects with an end region of the elongate link.

9. The system of claim 1 additionally including a second latch mechanism adapted to be connected to the selected one of the closure and the structure at a location 1) that is spaced from where the first push button operator assembly is connected to the selected one of the first closure and the structure, and 2) that is spaced from where the first latch mechanism is connected to the selected one of the first closure and the structure, wherein the second latch mechanism is adapted to receive and latchingly retain a second striker that is connected to a remaining one of the closure and the structure when the closure is in the closed position, wherein the second latch mechanism has a second latch operating member that is movable between a non-operated position and an operated position, and wherein the second latch mechanism is opera- able to release the second striker in response to movement of the second latch operating member from the non-operated position to the operated position; and wherein the linking means also extends to the second latch mechanism for transmitting an operating force from the first push button operating assembly to the second latch mechanism for moving the second latch operating member from the non-operated position to the operated position in response to movement of the first arm from the one position to the another position in response to movement of the first push button from the normal position to the depressed position for operating the first and second latch mechanisms substantially in unison to release the first and second strikers.

10. The system of claim 1 wherein the first push button operator assembly includes a key operated lock for selectively preventing movement of the first push button from causing movement of the first arm.

11. The system of claim 10 wherein the key operated lock is operable to move a cam connected to the first push button into and out of alignment with the first arm to selectively permit and prevent depression of the first push button from causing movement of the first arm.

12. The system of claim 1 additionally including a second push button operator assembly having a second housing adapted to be connected to the selected one of the closure and the structure, and having means for connecting with the linking means for transmitting an operating force thereto for moving the first latch operating member from the non-operated position to the operated position including a second push button that is movable relative to the second housing between a normal position and a depressed position.

13. The system of claim 12 wherein the second push button operator assembly includes a key operated lock for selectively preventing the movement of the second push button from causing the linking means to operate the first latch mechanism.

14. The system of claim 13 wherein the key operated lock is operable to move a cam connected to the second push button into and out of alignment with an end region of the elongate link to selectively permit and prevent depression of the second push button from causing movement of the elongate link.

15. The system of claim 12 wherein the linking means includes a common elongate link that extends among the first and second push button operator assemblies and the first latch mechanism that needs to be moved in one direction along its length in order to operate the first latch mechanism, and wherein the first and second push button operator assemblies are operable, when the push buttons thereof are moved from the normal positions to the depressed positions thereof, to move the elongate link in said one direction.

16. The system of claim 15 additionally including a second latch mechanism for engaging a second striker and having a second latch operating member that is connected to the elongate link that is operable, when the elongate link moves in said one direction, to operate the second latch mechanism to release the second striker.

17. A system for releasably retaining a closure in a closed position adjacent a structure that defines an opening that is closed by the closure when the closure is in the closed position, comprising:

a) a first push button operator assembly having a first housing adapted to be connected to a selected one of the closure and the structure, having a first push button that is movable relative to the first housing between a normal position and a depressed position, and having means for biasing the first push button away from the depressed position toward the normal position;

b) a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position;

c) wherein the first push button operator assembly includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position;

d) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker; and, e) wherein the exterior surface of the first housing that is clampingly engaged by the first bracket is defined by a base portion of a groove that extends about at least a perimeter portion of the first housing.

18. The system of claim 17 wherein the first bracket includes first and second relatively movable members and means for clamping the first and second relatively movable members into engagement with the base portion of said groove.

19. The system of claim 18 wherein the means for clamping the first and second relatively movable members into engagement with the base portion of said groove includes at least one threaded fastener that extends through a hole formed through the first of the relatively movable members and threads into a threaded hole formed through the second of the relatively movable members.

20. A system for releasably retaining a closure in a closed position adjacent a structure that defines an opening that is closed by the closure when the closure is in the closed position, comprising:

a) a first push button operator assembly having a first housing adapted to be connected to a selected one of the closure and the structure, having a first push button that is movable relative to the first housing between a normal position and a depressed position, and having means for biasing the first push button away from the depressed position toward the normal position;

b) a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position;

c) wherein the first push button operator assembly includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position;

d) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker; and, e) wherein the first bracket includes a first member configured to engage one side of the external surface of the first housing, a second member configured to engage an opposite side of the external surface of the first housing, and means for clamping the first and second members toward each other and into secure engagement with the one and opposite sides of the external surface of the first housing.

21. The system of claim 20 wherein the means for clamping includes at least one threaded fastener that extends through a hole formed through the first member and threads into a threaded hole formed through the second member.

22. The system of claim 21 wherein the first and second members are pivotally connected.

23. A system for releasably retaining a closure in a closed position adjacent a structure that defines an opening that is closed by the closure when the closure is in the closed position, comprising:

a) a first push button operator assembly having a first housing adapted to be connected to a selected one of the closure and the structure, having a first push button that is movable relative to the first housing between a normal position and a depressed position, and having means for biasing the first push button away from the depressed position toward the normal position;

b) a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position;

c) wherein the first push button operator assembly includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position;

d) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker; and, e) wherein the first bracket includes structure defining an L-shaped configuration having first and second leg portions that extend substantially at right angles relative to each other, wherein the first leg portion is adapted to clampingly engage the exterior surface of the first housing, and the second leg is pivotally connected to the first arm and mounts the first arm for pivotal movement about an axis that substantially parallels a plane of the first leg portion.

24. The system of claim 23 wherein the first arm defines a stop formation that is engageable with a the second leg portion when the first arm is at at least one end of a range of permitted pivotal movement of the first arm.

25. The system of claim 24 wherein the first arm is formed as a stamping from sheet metal, and the stop formation is defined by a dimple stamped into one side of the arm so as to cause a metal projection to extend from an opposite side of the arm.

26. The system of claim 23 wherein the first arm is an elongate lever that has first and second spaced regions located along a length thereof, wherein the first push button engages the lever in the first region, and the linking means engages the lever in the second region.

27. The system of claim 26 wherein the first and second regions are located on opposite sides of said axis of pivotal movement of the first arm, and depression of the first push button while in engagement with the first region causes the second region to move the linking means in an opposite direction as the first push button moves from the normal position to the depressed position.

28. The system of claim 26 wherein the first and second regions are located on a same side of said axis of pivotal movement of the first arm, and depression of the first push button while in engagement with the first region causes the second region to move the linking means in substantially the same direction as the first push button moves in being moved from the normal position to the depressed position.

29. A system for releasably retaining a closure in a closed position adjacent a structure that defines an opening that is closed by the closure when the closure is in the closed position, comprising:

a) a first push button operator assembly having a first housing adapted to be connected to a selected one of the closure and the structure, having a first push button that is movable relative to the first housing between a normal position and a depressed position, and having means for biasing the first push button away from the depressed position toward the normal position;

b) a first latch mechanism adapted to be connected to the selected one of the closure and the structure at a location spaced from where the first push button operator assembly is connected to the selected one of the first closure and the structure, wherein the first latch mechanism is adapted to receive and latchingly retain a first striker that is connected to a remaining one of the closure and the structure when the closure is in the closed position, wherein the first latch mechanism has a first latch operating member that is movable between a non-operated position and an operated position, and wherein the first latch mechanism is operable to release the first striker in response to movement of the first latch operating member from the non-operated position to the operated position;

c) wherein the first push button operator assembly includes means for defining a first bracket for being clamped into engagement with an exterior surface of the first housing for establishing a rigid connection between the first bracket and the first housing, and means for defining a first arm that is pivotally connected to the first bracket for being engaged by the first push button so as to be pivoted from one position to another position in response to movement of the first push button from the normal position to the depressed position;

d) linking means for extending from the push button operating assembly to the first latch mechanism for transmitting an operating force from the first push button operating assembly to the first latch mechanism for moving the first latch operating member from the non-operated position to the operated position in response to movement of the first arm from the one position to the another position in response to movement of the first push button from the normal position to the depressed position for operating the first latch mechanism to release the first striker; and, e) wherein the first bracket includes first and second members formed as stampings from sheet metal that are configured to engage opposite sides of the external surface of the first housing and to be clamped toward each other to clampingly engage the first housing, and the first arm is formed as a stamping from sheet metal and is pivotally connected to a selected one of the first and second members.

30. A system for releasably retaining a closure in a closed position adjacent a structure that defines an opening that is closed by the closure when the closure is in the closed position, comprising:

a) a first push button operator assembly connected to the structure at a first position;

b) a second push button operator assembly connected to the structure at a second position spaced from the first position;

c) at least one latch assembly connected to the structure at a third position spaced from the first and second positions, and arranged to receive and latchingly retain a striker connected to the closure when the closure is in the closed position;

d) linking means for defining at least one link that extends among the first, second and third positions for transmitting an operating force from either of the first and second push button operator assemblies to the at least one latch mechanism to unlatch the at least one latch mechanism from the striker to permit the closure to be moved away from the closed position to an open position;

e) wherein each of the first and second push button operator assemblies has a housing, a push button slidably supported by the housing for movement between a normal position and a depressed position, and biasing means for biasing the push button away from the depressed position toward the normal position;

f) wherein a selected one of the first and second push button operator assemblies also includes means for clamping, and an L-shaped bracket having first and second legs, with the first leg being clamped, by the means for clamping, into engagement with at least one side surface portion of the housing of the selected one of the first and second push button operator assemblies, and means pivotally mounted on the second leg of the bracket for applying an operating force to the linking means for operating the at least one latch mechanism in response to movement of the push button of the selected push button operator assembly from the normal position thereof to the depressed position thereof; and, g) means for interconnecting the push button of the other of the first and second push button operator assemblies with the linking means for applying an operating force to the linking means for operating the at least one latch mechanism in response to movement of the push button of said other of the first and second push button operator assemblies from the normal position thereof to the depressed position thereof.

31. The system of claim 30 wherein the means pivotally mounted on the bracket includes an elongate arm that has first and second spaced regions located along a length of the arm, wherein the push button of the selected assembly engages the arm in the first region, and the linking means engages the arm in the second region.

32. The system of claim 31 wherein the first and second regions are located on opposite sides of an axis about which the arm pivots relative to the bracket.

33. The system of claim 31 wherein the first and second regions are located on a same side of an axis about which the arm pivots relative to the bracket, and depression of the push button while in engagement with the first region causes the second region to move the linking means in substantially the same direction as the push button moves in being moved from the normal position to the depressed position.

34. The system of claim 30 wherein the at least one latch mechanism includes a pair of latch mechanisms connected to the structure at spaced locations thereon and connected to the linking means for being concurrently operated to release separate strikers that are connected to the closure at spaced locations thereon, and wherein each of the push button operator assemblies can have the push button thereof depressed to move the linking means to substantially concurrently operate the pair of latch mechanisms to release the strikers.

35. The system of claim 30 wherein the latch mechanism includes:

a) a frame formed as a one-piece stamping from sheet metal and having a relatively flat base portion that extends within a first plane, a pair of formations that extend away from the base portion in a plane that substantially parallels the first plane to define first and second arms that define a striker receiving channel between opposed portions of the first and second arms;

b) means for defining a generally cylindrical mounting pin that is connected to and extends away from the flat base portion along an axis that is substantially perpendicular to the first plane;

c) an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis;

d) means for defining a limited range of permitted relative pivotal movement that can take place between the operating arm and the frame including first and second spaced-apart stop formations defined by a selected one of the frame and the operating arm, and a stop engageable formation defined by the other of the frame and the operating arm that is configured to engage the first stop formation at one end of said range of movement, and to engage the second stop formation at the other end of said range of movement;

e) a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel;

f) means for permitting the latch arm to move in said one direction of rotation without causing corresponding pivotal movement of the operating arm in said one direction to thereby enable a striker to be moved rapidly into the striker receiving channel and into latched engagement with the latch assembly without causing pivotal movement of the operating arm if the striker engages the first surface and thereby causes the latch arm to pivot out of the path of travel followed by the striker in moving into the striker receiving channel;

g) biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, h) means for defining on the operating arm at a location spaced from said axis at least one connection formation for receiving an application of torque to the operating arm for rotating the operating arm in said one direction of rotation to drive the latch arm in said one direction of rotation to pivot the hook-shaped formation of the latch arm to position the second surface so that it does not block withdrawal of the striker from the striker receiving channel to thereby unlatch the latch mechanism from retainingly engaging the striker.

* * * * *